United States Patent [19]

Woodruff

[11] 4,357,925

[45] Nov. 9, 1982

[54] DISTRIBUTOR INJECTION PUMP FOR DIESEL ENGINES

[75] Inventor: Frank Woodruff, New Hartford, N.Y.

[73] Assignee: The Bendix Corporation, Teterboro, N.J.

[21] Appl. No.: 217,299

[22] Filed: Dec. 17, 1980

[51] Int. Cl.[3] ..... F02M 37/04

[52] U.S. Cl. ..... 123/506; 123/450; 123/458; 123/459; 417/462

[58] Field of Search ..... 123/506, 458, 459, 450; 417/462

[56] References Cited

U.S. PATENT DOCUMENTS

| | | | |
|---|---|---|---|
| 2,784,670 | 3/1957 | High et al. | 417/485 |
| 2,869,529 | 1/1959 | Ofenfart et al. | 123/501 |
| 3,485,225 | 12/1969 | Bailey et al. | 123/450 |
| 3,779,225 | 12/1973 | Watson et al. | 123/458 |
| 3,851,635 | 12/1974 | Murtin et al. | 123/458 |
| 3,859,972 | 1/1975 | Watson et al. | 123/500 |
| 3,880,131 | 4/1975 | Twaddell et al. | 123/500 |
| 4,125,104 | 11/1978 | Stein | 123/457 |
| 4,146,003 | 3/1979 | Drori | 417/462 |
| 4,173,959 | 11/1979 | Sosnowski et al. | 123/501 |
| 4,200,072 | 4/1980 | Bailey | 123/450 |
| 4,201,170 | 5/1980 | Overfield | 123/506 |
| 4,214,564 | 7/1980 | Skinner | 123/502 |
| 4,241,714 | 12/1980 | Knape et al. | 123/499 |

FOREIGN PATENT DOCUMENTS

| | | | |
|---|---|---|---|
| 2037365A | 7/1980 | United Kingdom | 123/450 |

*Primary Examiner*—Ira S. Lazarus
*Assistant Examiner*—Magdalen Moy
*Attorney, Agent, or Firm*—Anthony F. Cuoco; James R. Ignatowski

[57] ABSTRACT

A distributor injection pump for diesel engines is disclosed. The pump includes a hydraulically balanced distributor head housing the moving parts of a cam actuated opposed piston injection pump rotatably driven in synchronization of the engine. A single solenoid valve disposed along the spill path of the injection pump controls the timing and duration of the fuel injection pulses generated at each of the pump's distributor output ports.

20 Claims, 12 Drawing Figures

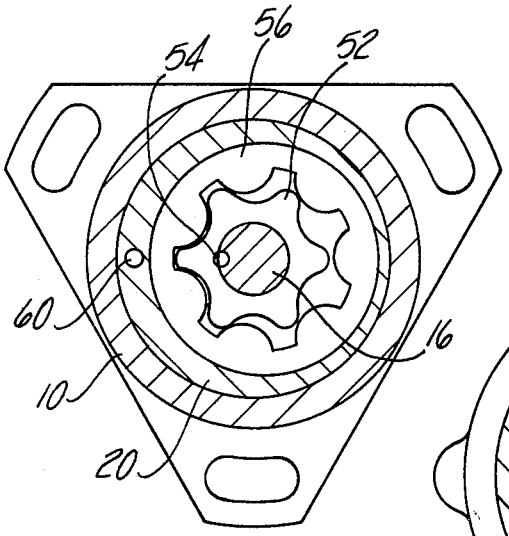
Fig-3
Fig-4
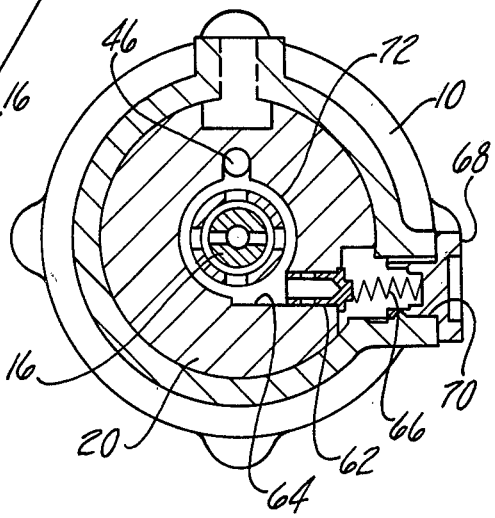
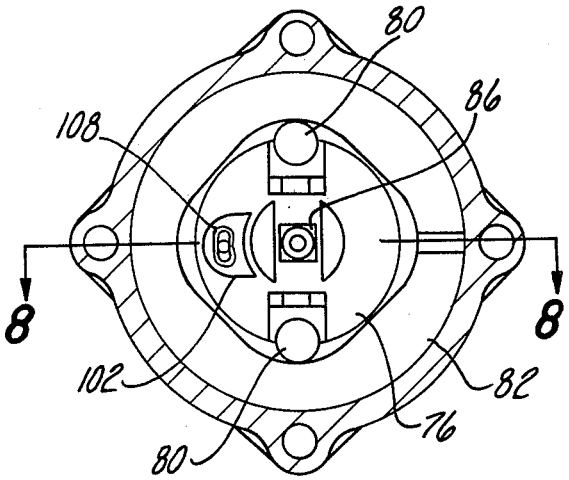
Fig-5
Fig-6
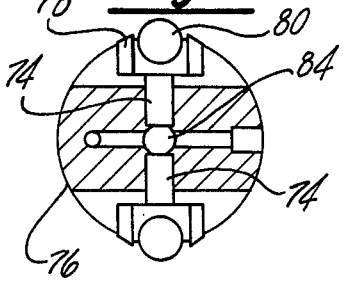
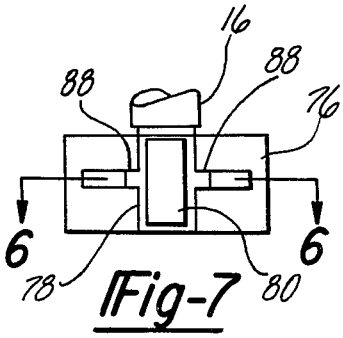
Fig-7

DISTRIBUTOR INJECTION PUMP FOR DIESEL ENGINES

CROSS REFERENCE

This application is related to and discloses elements of the distributor pump independently claimed in commonly assigned copending patent application Ser. No. 217,298, filed on Dec. 17, 1980 concurrently herewith.

BACKGROUND OF THE INVENTION

1. Field of the Invention

The invention is related to the field of fuel injection pumps and in particular to a distributor fuel injection pump in which the period of fuel injection is controlled in response to an electric signal.

2. Prior Art

Distributor fuel injection pumps in which the period of fuel injection is controlled mechanically or hydraulically are well known in the art. The injector pumps disclosed by Stein in U.S. Pat. No. 4,125,104, Sosnowski et al. in U.S. Pat. No. 4,173,959 and Bailey in U.S. Pat. No. 4,200,072, are typical of these types of distributor fuel injector pumps. Recent advances in electronics have resulted in the development of electronic fuel control units which are capable of more accurately computing fuel requirements in response to one or more operational parameters of the engine. These electronic control units are capable of not only computing the required fuel quantity, but also the time at which the fuel is to be injected into the cylinder to optimize the engine's performance. Concurrent with this development has been the development of distributor injection pumps in which the fuel quantity and injection timing are electrically controlled in response to electrical signals generated by electromechanical devices as well as electronic control units. Typical examples of electrically controlled distributor fuel injection pumps are disclosed by Watson et al. in U.S. Pat. Nos. 3,779,225 and 3,859,972 and by Twaddell et al. in U.S. Pat. No. 3,880,131. In U.S. Pat. No. 3,779,225, Watson et al. discloses a distributor injection pump which requires one electrically activated solenoid valve for each output injection port. Alternatively, Watson et al. and Twaddell et al. in U.S. Pat. Nos. 3,859,972 and 3,880,131 disclose injection pumps using two electrically activated solenoid valves. One of the solenoid valves initiates the beginning of the fuel injection pulse and the second terminates the injection pulse. Both solenoid valves act to spill the high pressure injection pulse in its unenergized state.

The disclosed distributor injection pump is an improvement over the injection pumps of the prior art.

SUMMARY OF THE INVENTION

The invention is a distributor fuel injection pump having a face type distribution head and in which the timing and duration of the generated fuel pulse are capable of being controlled in response to electrical signals received from an external source. The pump comprises a charge pump and a cam actuated opposing piston or plunger injection pump contained within a common housing. A shaft adapted to be rotatably driven by a rotating member of the engine actuates both the charge and injection pumps in synchronization with the rotation of the engine. A normally open solenoid valve disposed along the spill path of the injection pump controls the timing and duration of the fuel injection pulses generated by the injection pump. The moving parts of the injection pump are housed in a hydraulically balanced distributor head which sequentially interconnects the output of the injector pump with the output or injector ports of the pump.

One advantage of the pump is that the distribution functions and the injector pump are incorporated in a single member simplifying the structure of the pump. Another advantage of the pump is that the distributor head is hydraulically balanced reducing the internal forces on its internal members increasing the operational life of the pump. Another advantage of the disclosed distributor injection pump is that the time and duration of the fuel injection pulses are capable of being controlled by a single solenoid valve. These and other advantages of the disclosed distributor fuel injection pump will become apparent from the detailed description of the pump and the apended drawings.

BRIEF DESCRIPTION OF THE DRAWINGS

FIG. 3 is a cross-sectional view showing the details of the charge pump.

FIG. 4 is a cross-sectional view showing the details of the poppet valve.

FIG. 5 is a cross-sectional view showing the details of the distributor head.

FIG. 6 is a cross-sectional view of the distributor head showing the details of the injection pump.

FIG. 7 is a top view of the distributor head showing details of the cam follower.

DETAILED DESCRIPTION OF THE PREFERRED EMBODIMENT

Figure 1:
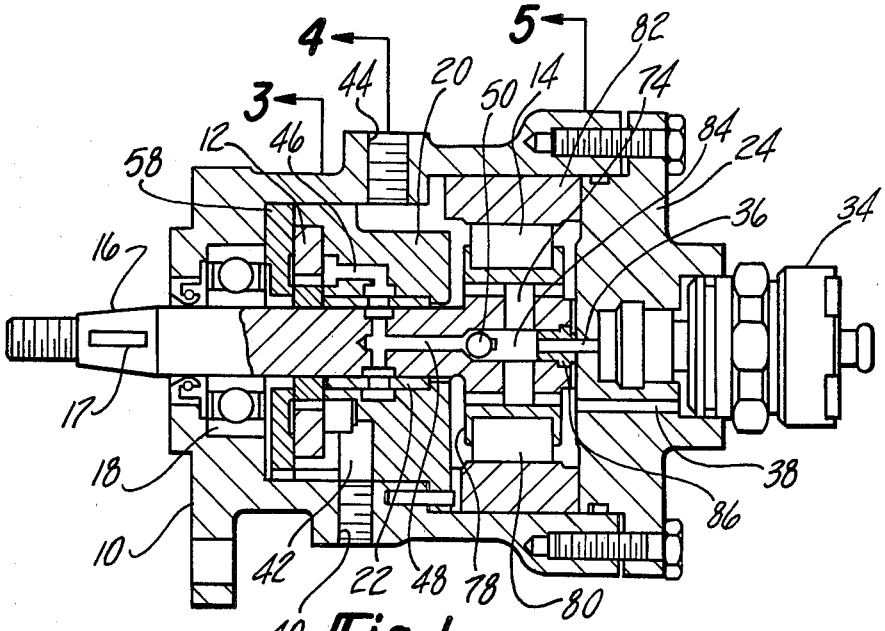
FIG. 1 is a cross-sectional side view of the disclosed pump.
Figure 2:
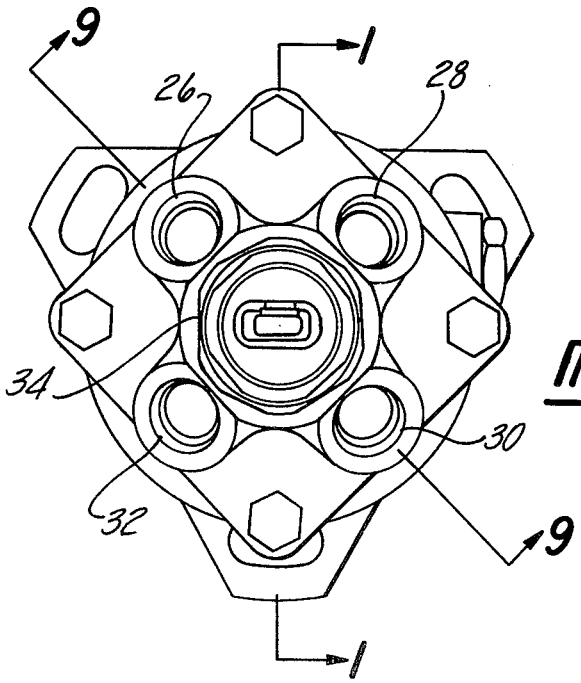
FIG. 2 is an end view of the pump.

FIGS. 1 and 2 are a cross-sectional side view and a front view of a distributor injection pump for a four cylinder diesel engine respectively. Referring first to FIG. 1 the distributor injection pump has a housing 10 enclosing a charge pump 12 and an injection pump 14 connected to a common shaft 16. The shaft 16 is rotatably supported at one end of the housing 10 by a ball bearing 18 and internally within the housing by bearing block 20 and bushing 22. The external end of the shaft 16 has a key 17 to provide proper orientation between the injection pump 14 and the pistons in the engine.

The opposite end of the housing 10 is enclosed by a distributor block 24 having four (4) injection ports 26 through 32 as shown in FIG. 2. A normally open solenoid valve 34 is attached to the distributor block 24 concentric with shaft 16. The input to the solenoid valve is connected to an axially disposed spill port of the injection pump 14 by an inlet bore 36. The outlet of the solenoid valve is connected to the case fluid supply through return bore 38.

The charge pump receives fluid from an external supply through an inlet port 40 passing through the wall of housing 10 and a mating passageway 42 formed in bearing block 20. Case fluid is transmitted back to the external fluid supply through a return port 44. The outlet of the charge pump 12 is connected to the inlet of the injection pump 14 through passageway 46 formed in bearing block 20 and bushing 22 and an axial bore 48 formed through shaft 16. A check valve 50 disposed at the end of axial bore 48 provides for undirectional fluid flow between the charge pump 12 and the injection pump 14.

The charge pump 12 is an internal gear pump of conventional design as illustrated in FIG. 3. The gear pump comprises an inner rotor 52 keyed to shaft 16 by round key 54, and an outer rotor 56. The outer rotor 56 runs in an off-center cylindrical cavity formed in bearing block 20. Inlet ports and outlet ports for the gear pump are formed in the bearing block 20 and matching shadow ports are formed in an opposing port plate 58 as shown in FIG. 1. Bearing block 20 and port plate 58 are held in a fixed non-rotative relationship to housing 10 by a pin 60.

Surplus fluid flow from charge pump 12 is relieved through a charge pump relief valve as shown in FIG. 4. Referring to FIG. 4 the charge pump relief valve comprises a poppet 62 slidably received in bore 64 formed in bearing block 20. Poppet 62 is resiliently retained in bore 64 by a spring 66 disposed between the head of poppet 62 and a cap 68 threadably received in a threaded aperture 70 formed in housing 10. Bore 64 connects to annular cavity 72 formed about the internal diameter of bearing block 20. The fluid output of the charge pump 12 is transmitted to the annular cavity 72 by passageway 46 as shown in FIG. 1.

The injection pump is a cam actuated, opposing piston or plunger pump of conventional design. Referring to FIGS. 1, and 5 through 8 the injection pump comprises a pair of opposing plungers 74 disposed in a diametrical guide bore passing through a distributor head 76 formed at the internal end of shaft 16. The end of each plunger 74 abuts a cam follower comprising a shoe 78 and a roller 80. The roller 80 of the cam follower rolls along the internal surface of a annular cam 82. The internal surface of cam 82 has a plurality of symmetrically disposed lobes equal in number to the number of injection ports of the pump. In the illustrated embodiment cam 82 has four lobes which correspond in number to the four injection ports 26 through 32.

An axial bore 84 formed in the distributor head 76 interconnects the diametrical bore housing plungers 74 with the output of the charge pump 12 through check valve 50, axial bore 48 and interconnecting bore 46. A spill port insert 86 is disposed in the end of axial bore 84 opposite the check valve 50. Insert 86 has an axial spill port connecting bore 84 with the inlet to the solenoid valve 34 through inlet bore 36 formed in distributor block 24.

The shoe 78 of the cam follower may have a pair of wing projections 88 confined by a slot in the distributor head 76 as shown in FIG. 7. The wing projections 88 prevent lateral displacement of the cam followers with the rotation of the distributor head 76.

Figure 8:
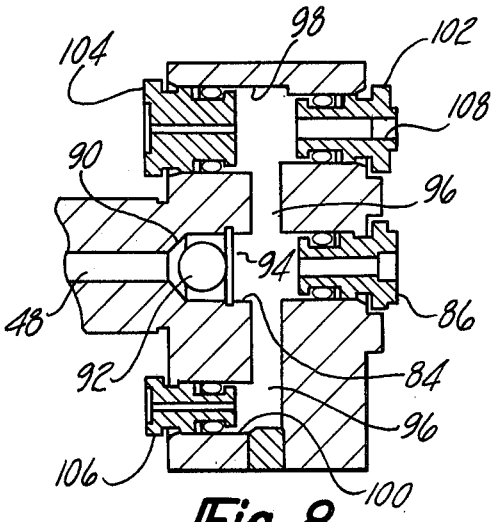
FIG. 8 is an enlarged cross-sectional view of the distributor head showing the details of distributor.

The check valve 50 comprises a valve seat 90 formed at the junction between bores 48 and 84, a ball 92 and a retainer 94 disposed in an annular groove formed in bore 84 as shown in FIG. 8.

The distributor head 76 also includes a second diametrical bore 96 disposed normal to the diametrical guide bore housing plungers 14. Bore 96 interconnects the axial bore 84 with a pair of diametrically opposite insert bores 98 and 100 as shown on FIG. 8. An output insert 102 is disposed in insert bore 98 on the same side of the distributor head as insert 86. A first hydraulic balance insert 104 is disposed in the opposite end of insert bore 98. Insert bore 100 only passes part way through the distributor head 76 and receives a second hydraulic balance insert 106. Inserts 104 and 106 have circular exit apertures and hydraulically balance the forces on the distributor head 76 as shall be described hereinafter. Output insert 102 has a kidney shaped exit aperture 108 forming an output port as shown on FIG. 5. The displacement angle of shaft 16 subtended by the kidney shaped aperture 108 of insert 102 is sufficient to cover all required injection events of the injection pump.

Figure 9:
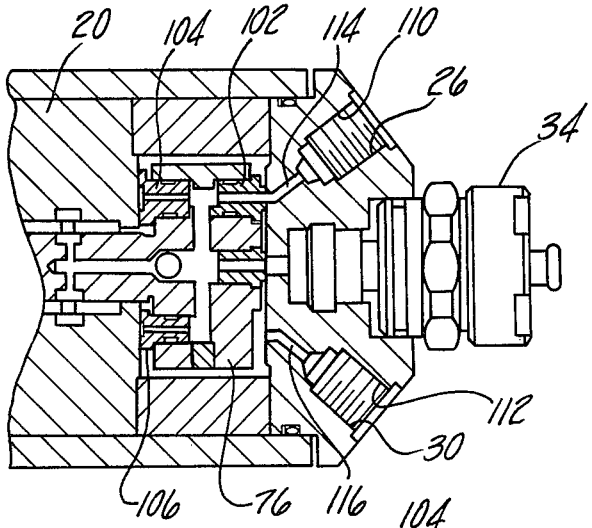
FIG. 9 is a partial cross-sectional view taken through the distributor ports.

Referring now to FIG. 9, there is shown a partial cross-section of the injection pump passing through injection ports 26 and 30. Each of the injection ports has a threaded outlet bore, such as bores 110 and 112, and an elbow shaped passageway, such as passageways 114 and 116, connecting the threaded outlet bores with the injection pump 14 through output insert 102. The ends of the elbow shaped passageways lie on the circumference of a circle defined by the kidney shaped aperture 108 of insert 102 as the distributor head 76 rotates with shaft 16. The apertures of hydraulic balance inserts 104 and 106 are terminated against the adjacent surface of bearing block 20 as shown.

The operation of the injection pump is as follows. The shaft 16 is connected to a rotary member, such as the cam shaft, of an internal combustion engine which rotates at one half the speed of the engine and in synchronization therewith. Key 17 on shaft 16 provides for proper synchronization of the shaft 16 with pistons in the engine.

Rotation of shaft 16 activates the charge pump 12 to provide a fluid flow to injection pump 14 through bores 46, 48 and check valve 50. The fluid being supplied to the injection pump 14 is controlled at an intermediate pressure by poppet valve 62 and spring 66. As the injection pump 14 rotates with shaft 16, the plungers 74 reciprocate in opposing directions producing a fluid flow each time the cam followers encounter a lobe of cam 82. Cam 82 is oriented with respect to the housing 10 and distributor block 24 so that a fluid flow is generated each time the kidney shaped aperture 108 of insert 102 is coincident with the internal end of one of the elbow shaped passageways of the injection ports.

In its unenergized state, the normally open solenoid valve 34 allows the fluid flow generated by the injection pump 14 to be transmitted directly to the case supply through return passageway 38. Energizing solenoid valve 34, blocks this return passageway and the fluid flow is now directed to the injection port having the entrance of its elbow shaped passageway coincident with the kidney shaped aperture 108 of insert 102. In this manner the beginning and end of each fluid flow pulse produced at the individual injection ports of the pump is determined by the electrical signal energizing the solenoid valve 34.

The electrical signals energizing the solenoid valve 34 may be generated by any of the conventional electromechanical and electronic devices known in the art. Typically the electrical signals would be generated by an electronic control unit of any known type which is capable of generating the required electrical signals in response to the operational parameters of the engine.

Such electronic control units are capable of computing the time and quantity of fuel to be injected into the engine to optimize its performance under the given operational conditions.

Figure 10:
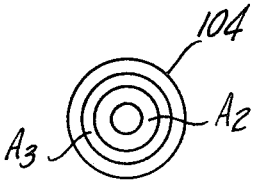
FIGS. 10 and 11 are enlarged end and side views of one of the inserts used to explain the hydraulic balance of the inserts.
Figure 11:
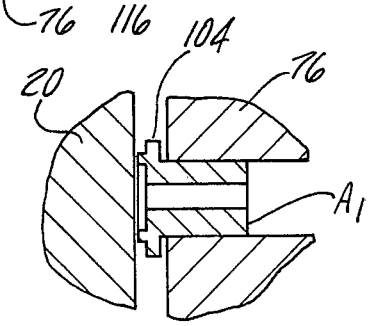

As previously indicated the hydraulic balance inserts 104 and 106 hydraulically balance the forces produced on the distributor head 76 during the generation of a fuel flow by the injection pump. Considering first the balancing of the hydraulic forces acting on each insert. Referring to FIGS. 10 and 11 the force $f_1$ urging an insert, such as insert 104, outwardly from the distributor head 76 is the pressure of the fluid P times the surface area $A_1$. The forces $f_2$ and $f_3$ urging the insert back into the distributor head is surface area $A_2$ times the pressure P and surface area $A_3$ times $\frac{1}{2}$ the pressure P where it is assumed the average pressure of the fluid acting between area $A_3$ and surface of the bearing block 20 is one half the difference between the pressure P and the case pressure which is approximately zero. For hydraulic balance of the insert then:

$$f_1 = f_2 + f_3$$

$$\text{or } A_1 = A_2 + \tfrac{1}{2}A_3$$

Figure 12:
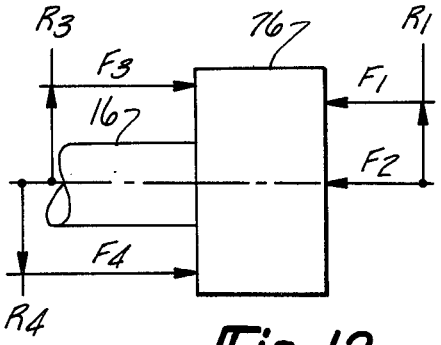
FIG. 12 is a force diagram showing the hydraulic forces on the distributor head during an injection pulse.

The hydraulic forces acting on the distributor head 76 are illustrated in FIG. 12 where $F_1$ is the force produced at the output insert 102, $F_2$ is the force produced at spill insert 86, $F_3$ is the force produced at insert 104 and $F_4$ is the force produced at insert 106. $R_1$, $R_2$, and $R_3$ are the radial distances from the axis of the distributor head where the corresponding forces are applied. For hydraulic balance of the distributor head the following equations for linear forces and rotational torque must be satisfied.

$$F_1 + F_2 = F_3 + F_4 \quad \text{(linear)}$$

$$\text{and } F_1R_1 = F_3R_3 - F_4R_4 \quad \text{(torque)}$$

The parameters $F_1$, $F_2$ and $R_1$ are normally dictated by the mechanical restraints and performance requirements of the pump, therefore the parameters $F_3$, $F_4$, $R_3$ and $R_4$ may be determined by simultaneous solutions of the above two equations.

It is not intended that the invention be limited to the specific embodiment of the distributor injection pump illustrated and described herein. A person skilled in the art may increase the number of injection ports or make other changes to the disclosed pump without departing from the scope and spirit of the invention as set forth in the apended claims.

What is claimed is:

1. A distributor fuel injection pump comprising:

a generally cylindrical housing having a fuel inlet port and a distributor block normal to the axis of said housing and enclosing one end thereof, said distributor block having a plurality of injection ports symetrically disposed therethrough along the circumference of a circle concentric with the axis of said housing;

a shaft concentric with the axis of said housing having one end adapted to be rotatably driven and the other end supported for rotation within said housing;

charge pump means connected to said shaft for increasing the pressure of fuel received at said fuel inlet port to an intermediate pressure;

a distributor head connected to said other end of said shaft and rotatable therewith, said distributor head having a face normal to said housing's axis and adjacent to the internal surface of said distributor block, an axial bore concentric with said shaft interconnected at its internal end to the output of said charge pump, a check valve disposed at said internal end of the axial bore for providing a unidirectional fluid flow from said charge pump into said axial bore, a diametrical bore intercepting said axial bore downstream of said check valve, a distributor port disposed in said face of the distributor head offset from the axis of said shaft a distance equal to the radius of said circle, and a fluid passageway interconnecting said distributor port with said axial bore;

a stationary annular cam circumscribing said distributor head, said cam having a plurality of lobes equal in number to said plurality of injection ports symetrically disposed along its internal surface;

an injection pump having its moving parts disposed in said distributor head, said injection pump having a pair of opposing plungers disposed in said diametrical bore, one either side of the axis of said shaft and a pair of cam followers, one disposed between each of said plungers and the internal surface of said annular cam, the lobes of said annular cam displacing said plungers towards each other generating a high pressure fuel flow in said axial bore which is applied to said distributor port each time said distributor port is connected to one of said injection ports.

2. The distributor injection pump of claim 1 wherein said housing further includes a return port and said distributor block includes a spill passageway concentric with the axis of said shaft and a return passageway connected to said return port, said distributor head further includes a spill port at the other end of said internal bore interconnecting said internal bore with said spill passageway and said distributor pump further includes solenoid valve means connected to said distributor block, said solenoid valve means having a first state interconnecting said spill and return passageways, and a second state in response to an electrical signal blocking the interconnection between said spill and return passageways causing said fluid flow to be transmitted to one of said injection ports through said distributor port.

3. The distributor injection pump of claim 1 wherein said distributor port has a kidney shaped aperture maintaining connection with each of said internal inlet over a predetermined angular rotation of said shaft, said predetermined angular rotation subtending an angle which encompasses all angles at which a fuel flow is required at any one injection port.

4. The distributor injection pump of claim 2 wherein said distributor head further includes means for hydraulically balancing said distributor head with respect to the forces generated at said spill port and said distributor port.

5. The distributor injection pump of claim 4 wherein said pump further includes a bearing block supporting said shaft for rotation within said housing and wherein said bearing block has a second surface proximate a surface of said distributor head opposite said spill port and said distributor port, said means for hydraulically balancing includes at least one balancing port connected to said axial bore and exiting on said second surface for producing a force between said bearing block and said distributor head opposite and equal to the hydraulic forces produced by said spill port and said distributor ports.

6. The distributor injection pump of claim 5 wherein said at least one port is two ports diametrically disposed on opposite sides of said axis for generating a pair of forces balancing both the linear and rotational hydraulic forces generated by spill port and said distributor ports.

7. The distributor injection pump of claim 1 wherein said distributor head further includes means connected to said axial bore for producing a force counterbalancing the hydraulic forces on said distributor head generated at said spill port and said distributor ports.

8. In a distributor fuel injection pump for an internal combustion engine having a housing, an inlet port, a return port, a shaft adapted to be rotatably driven in synchronization with the engine and an injection pump connected to said shaft for producing a fuel flow at an outlet an improvement characterized by:

a distributor block enclosing one end of housing normal to the axis of said shaft, said distributor block having a plurality of injection ports adapted to be connected to the individual cylinders of the engine; said injection ports symetrically disposed along the circumference of a circle concentric with the axis of said shaft;

a bearing block disposed in the housing for supporting said shaft;

a distributor head connected to said shaft and rotatable therewith, said distributor head housing at least the moving elements of said injection pump and having a first face adjacent to said distributor block and an opposite face adjacent said bearing block said first face having a distributor port offset from the axis of said shaft a distance equal to the radius of said circle and interconnecting the output of said injection pump with said plurality of injection ports, one at a time in a predetermined sequence with the rotation of the shaft each time said injection pump produces a fuel flow, said first face further including a spill port concentric with the axis of said shaft and connected to the outlet of said injection pump, said opposite face having at least one balancing port having one end connected to the output of said injection pump to produce a hydraulic force counterbalancing the forces produced at said spill and distributor ports; and a solenoid valve interconnecting said spill port with said return port, said solenoid valve having an unenergized state conducting said fuel flow through said spill port to said return port and an energized state in response to an electrical signal, blocking said fuel flow through said spill port.

9. The improvement of claim 8 wherein said distributor port has a kidney shaped aperture maintaining connection with the inlet of each injection port over a predetermined angular rotation of said shaft, said kidney shaped aperture subtending an angle which encompasses all angles at which a fuel flow is required at any injection port.

10. The improvement of claim 8 wherein said at least one balancing port is two balancing ports diametrically disposed from each other on opposite sides of the axis of said shaft, said two balancing ports producing a hydraulic force balancing both the lateral and rotational hydraulic forces on said distributor head.

11. The improvement of claim 8 wherein said injection pump is a cam actuated opposed piston pump comprising:

an annular cam circumscribing said distributor head, said cam having a number of lobes on its internal surface equal in number to the number of injection ports;

a pair of pistons disposed in a diametrical bore passing through said distributor head normal to the axis of said shaft, one piston disposed in diametrical bore either side of said axis; and a pair of cam followers, one cam follower disposed between the external end of each piston and said cam, said cam followers oscillating said pistons in opposing directions as the cam followers engage the lobed internal surface of said cam with the rotation of said distributor head with said shaft.

12. The improvement of claim 8 wherein said distributor injection pump further includes a charge pump driven by said shaft for providing to said injection pump fuel at an intermediate pressure.

13. A distributor fuel injection pump comprising:

a housing having an end face, a fuel inlet port, and a plurality of injection ports disposed through said end face in a symetrical pattern about an axis of rotation;

a shaft having one end adapted to be rotatably driven and the other end disposed within said housing;

a bearing block disposed in said housing for rotatably supporting said other end of said shaft concentric with said axis of rotation;

face type distributor head means disposed at the end of said shaft between said end face and said bearing block, said distributor head means having a first face adjacent to said end face and a second face adjacent to said bearing block, said first face having a distributor port sequentially connected to said injection ports, one at a time, in a repetitive sequence with the rotation of said shaft, said second face having at least one balancing port interfacing said bearing block;

a cam actuated opposing plunger injection pump having its moving elements disposed within said distributor head means, said cam actuated opposing plunger injection pump receiving fuel from said inlet port and generating an intermittent fuel flow at an output connected to said distributor port, each time said distributor port is connected to one of said injection port, the fuel flow at said balancing port producing a hydraulic force counterbalancing the hydraulic force produced at said distributor port.

14. The distributor pump of claim 13 wherein said injection ports are symmetrically disposed on the circumference of a circle concentric with said axis of rotation, said distributor port is offset from the axis of said shaft a distance equal to the radius of said circle.

15. The distributor pump of claim 14 wherein said distributor port has a kidney shaped aperture maintaining connection with each of said injection ports over a predetermined angular rotation of said shaft, said predetermined angular rotation subtending an angle which encompasses all angles at which an injection fuel flow is required at any one injection port.

16. The distributor injection pump of claim 13 wherein said injection pump comprises:

a diametrical bore passing through said distributor head means normal to the axis of said shaft;

a pair of plungers disposed in said diametrial bore one either side of said axis;

an axial bore intercepting said diametrical bore and interconnected at one end to said inlet port;

a check valve disposed in the end of said axial bore interconnected to said inlet port for providing a unidirection fuel flow from said inlet port to said axial bore;

a stationary annular cam circumscribing said distributor head, said cam follower having a plurality of lobes equal in number to said plurality of injection ports symmetrically disposed along its internal surfaces;

a pair of cam followers slidably disposed in said distributor head between said plungers and the internal surface of said cam; and a fluid passageway in said distributor head interconnecting said axial bore with said distributor port and said balancing port.

17. The distributor injection pump of claim 13 wherein said housing has a return port and said distributor head means has a spill port connected to the output of said injection pump means, said distributor pump further includes a solenoid valve controlling the fluid flow generated by the injection pump means through said spill port in response to electrical signals, said solenoid valve having a first state enabling said fluid flow from said spill port to said return port and a second state blocking said fluid flow through said spill port.

18. The distributor injection pump of claim 13 wherein said at least one balancing port is two balancing ports diametrically disposed on opposite sides of said axis for generating a pair of forces balancing both the linear and rotational hydraulic forces generated at said distributor output port.

19. The distributor pump of claim 17 wherein said distributor head means further includes means connected to the output of said injection pump means for producing a force counter balancing the hydraulic forces on said distributor head generated at said spill port and said distributor port.

20. The distributor pump of claims 13 or 16 further including a charge pump for increasing the pressure of the fuel received at said inlet port to an intermediate pressure, and wherein said injection pump means receives fuel at said intermediate pressure from said charge pump.

* * * * *